United States Patent [19]

Bonin

[11] Patent Number: 4,933,612

[45] Date of Patent: Jun. 12, 1990

[54] EXCITATION CIRCUIT FOR GAS DISCHARGE LAMP

[75] Inventor: Wayne A. Bonin, Minneapolis, Minn.

[73] Assignee: Neonics, Inc., Minneapolis, Minn.

[21] Appl. No.: 256,739

[22] Filed: Oct. 12, 1988

[51] Int. Cl.[5] ..... H05B 37/02

[52] U.S. Cl. ..... 315/307; 315/209 T; 315/219; 315/291

[58] Field of Search ..... 315/209 R, 209 T, 219, 315/225, 240, 291, 306, 307

[56] References Cited

U.S. PATENT DOCUMENTS

| | | | |
|---|---|---|---|
| 3,703,677 | 11/1972 | Farrow | 321/45 R |
| 4,414,491 | 11/1983 | Elliott | 315/282 |
| 4,523,131 | 6/1985 | Zansky | 315/307 |
| 4,547,705 | 10/1985 | Hirayama et al. | 315/219 |
| 4,667,132 | 5/1987 | Leale | 315/282 |
| 4,686,428 | 8/1987 | Kuhnel et al. | 315/291 X |

*Primary Examiner*—Robert J. Pascal
*Attorney, Agent, or Firm*—Kinney & Lange

[57] ABSTRACT

An excitation circuit for a gas discharge lamp. The excitation circuit includes a rectifier for converting conventional line A.C. to D.C. The primary winding of a step up transformer and a switching element of an inverter circuit are connected in series across the output of the rectifier. The switching element is switched at a desired frequency, generating an A.C. signal across the primary winding of the transformer. The inverter circuit further includes a capacitor connected in parallel with the primary winding to provide a pseudo-resonant mode of operation in the primary winding when the switching element is off. Switching of the switching element is controlled by control circuitry, which responds to the voltage level at the interconnection of the primary winding and switching element for adjusting the relative on and off time of the switching element, controlling total current through the primary winding.

19 Claims, 2 Drawing Sheets

EXCITATION CIRCUIT FOR GAS DISCHARGE LAMP

BACKGROUND OF THE INVENTION

1. Field of the Invention

The present invention relates to excitation circuits for operation of gas discharge tubes, particularly neon lamps.

2. Technological Background

A neon lamp is an illumination device formed from a sealed glass tube containing an ionizable gas, such as neon or a combination of argon and mercury. It has electron emitting cathodes and electrical terminals at each end of the tube. Upon application of the appropriate electrical signal to the terminals, the gas ionizes and a glow discharge is supported through the tube between cathode and terminal. Different colors of light are emitted from the lamp depending upon the composition of the gas in the tube.

Neon lamps are usually driven by alternating current ("A.C.") power sources. Commercial electrical supplies are commonly used as a local source of power. In North America, electricity is supplied at a frequency of 60Hz and at a voltage typically between 110 to 120 volts. Increased voltages are required for exciting neon lamps and have been provided by using step up transformers between the line outlet supplying the commercial power and the lamp. However, operation of neon lamps at the low 60Hz frequency of commercial power results in an annoying level of low pitched noise from the transformer and requires the use of relatively bulky transformer components.

Recent excitation circuits for neon lamps, and other discharge devices, have utilized relatively high speed switching circuits called inverters to produce A.C. at frequencies in the area of several tens of thousands of Hertz. Low frequency commercial A.C. is converted to direct current ("D.C.") by a rectifier. A primary winding of a step up transformer and a solid state transistor switch are connected in series across the output terminals of the rectifier. The transistor switch, in part, provides the inverter element. The switch is driven in and out of conduction at the desired operating frequency, producing a high frequency A.C. in the primary winding of the transformer.

Application of A.C. at a frequency in excess of 15,000 to 20,000Hz to the primary winding of the step up transformer pushes the frequency of consequential transformer noise to a level beyond the threshold of human hearing. High frequency operation also allows a decrease in the bulk of transformer components, reduces heat loss from the transformer during operation and reduces the need for bulky structural support for a transformer. Additionally, operation of neon lamps at high frequency is more efficient, with energy consumption per lumen of light generated being reduced.

Good output power control from the excitation circuit requires that the peak voltage level between the switch and the primary winding of the transformer have a constant maximum. Output power control is important to insure proper operation of the lamp and to permit use of minimum cost components. Commercial A.C. is subject to peak and root mean square ("r.m.s.") voltage level excursions. Consequentially, the peak voltage level between the switch and the transformer primary winding will also be subject to excursions unless the circuit is capable of adjusting for such excursions. Load changes across the secondary winding affect the peak voltage across the switch to an even greater extent. Upward excursions of the peak voltage level can result in destruction of a solid state transistor switch.

SUMMARY OF THE INVENTION

The present invention provides a neon lamp excitation circuit for connection to conventional sources of commercial A.C. electrical power. A rectifier converts commercial, low frequency A.C. to filtered D.C. The D.C. is applied across the step up transformer and an inverter circuit connected in series with the primary winding of the step up transformer. The inverter circuit includes a switch element, which can be turned on to establish a current in the primary winding. The switch element is switched at a relatively high frequency providing high frequency A.C. across the primary winding. A timing circuit responsive to voltage levels at the junction between the inverter circuit and the primary winding controls the duration of the on or current conducting time of the switch element. This limits total current through the primary winding, controlling the power transferred through the transformer.

The primary winding of the step up transformer and the switching element of the inverter circuit are connected in series across the output of the rectifier. Thus the on time of the switching element determines a maximum forward current in the primary winding of the transformer. A capacitor is connected in parallel with the switching element and supports reverse current in the primary winding. The capacitor stores energy after the switching element establishes a forward current in the primary winding and is turned off. This results in reversal of the potential across the primary winding, eventually reversing the current in the primary winding and returning energy to the primary winding. The peak voltage produced across the primary winding during each cycle is a function of the forward current established in the primary winding in that cycle.

Peak voltage across the primary winding, current through the primary winding and power transferable through the transformer are controlled through on time duration control of switching element.

DETAILED DESCRIPTION OF THE PREFERRED EMBODIMENTS

Figure 1:
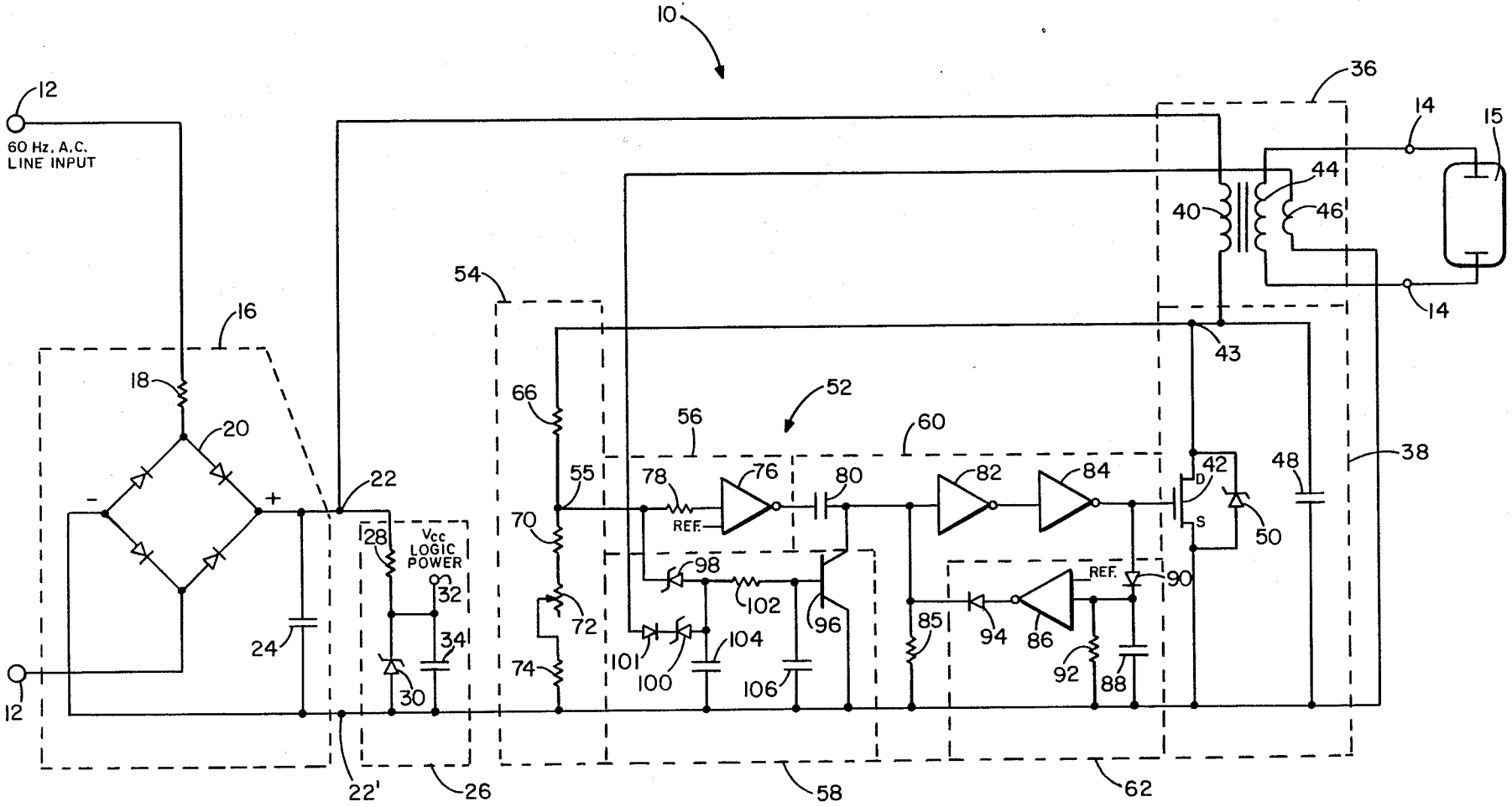
FIG. 1 is a circuit schematic of the excitation circuit.

FIG. 1 illustrates a gas discharge lamp excitation circuit 10, adapted to receive power by connection to a 60 Hz A.C. source on input terminals 12 and to generate a 5 to 200 KHz, or higher, frequency A.C. output signal on output terminals 14. Output terminals 14 are typically connected to a gas discharge lamp such as a neon lamp 15.

Input terminals 12 are connected to a rectifier 16, which includes an inrush current limiting resistor 18 and a diode bridge 20. Diode bridge 20 and current limiting resistor 18 are connected in series across input terminals 12. Opposite polarity D.C. input terminals 22 and 22' are connected to diode bridge 20 across a filtering capacitor 24 for providing D.C. power to the balance of excitation circuit 10. Where the input A.C. is 110 to 120 volts (r.m.s.) the D.C. output is between about 155 and 170 volts line to line.

A logic power supply circuit 26 is connected to opposite polarity D.C. input terminals 22 and 22' for providing 10 volt operating voltage $V_{cc}$ and reference voltage inputs to logic elements of excitation circuit 10. Connections between power supply 26 and the logic elements have been omitted for the sake of clarity. Resistor 28 and Zener diode 30, respectively, are connected in series from D.C. input terminal 22' to D.C. input terminal 22, with the Zener oriented to present its breakdown direction of conductivity toward positive polarity D.C. input terminal 22. The breakdown voltage of Zener diode 30 substantially sets the output voltage level on logic power supply terminal 32. Inrush limiting resistor 28 limits current into power supply 26 at start up and capacitor 34 evens the voltage output and prevents sudden voltage level transitions from occurring on power supply terminal 32. Those skilled in the art will be aware that logic power and reference voltages can be provided in numerous other ways.

High voltage, high frequency A.C. output conversion is provided by transformer 36 and inverter 38. Transformer 36 is a relatively high leakage-reactance type of transformer, commonly employed with excitation of neon lamps, because they provide ballest impedance for the neon lamp after initial excitation. Neon lamps are characterized by high start-up resistance and reduced resistance after start-up. Primary winding 40 of transformer 36 and an insulated gate field effect transistor ("IGFET") 42 are connected in series between D.C. input terminal 22 and D.C. input terminal 22' by interconnection 43. Secondary winding 44 is connected to A.C. output terminals 14 and provides a substantial voltage increase over the input voltage across primary winding 40. A second secondary winding 46 may be provided if definite open circuit output voltage limiting is required. Secondary winding 46 provides a stepped down signal proportional to voltage across secondary winding 44. Inverter 38 further includes a capacitor 48 connected in parallel with IGFET 42 between interconnection 43 and negative D.C. input terminal 22'. Zener diode 50 is an integrated part of certain types of metal oxide semiconductor field effect transistors ("MOSFET") usable for IGFET 42 and is shown with its breakdown direction of conductivity connecting the drain to the source of IGFET 42. Zener 50, where present, protects IGFET 42 from excessive drain to source voltage excursions.

Control of primary current through primary winding 40, voltage across the primary winding and, ultimately, power available for transfer through transformer 36 is controlled by controlling the periods of conductivity of IGFET 42. IGFET 42, as explained more fully below, is used to establish forward primary current in primary winding 40. Once a primary current is established IGFET 42 can be switched to a nonconductive state allowing capacitor 48 to charge for ultimately reversing the voltage drop across, and the current in, primary winding 40. Switching of IGFET 42 is controlled by an inverter control circuit 52. Inverter control circuit 52 includes a voltage divider circuit 54, a control signal trigger circuit 56, a control signal duration control circuit 58, a control signal transmission link 60 and an oscillation initiation circuit 62.

The voltage level at interconnection 43 relative to D.C. input terminal 22' is a function of the voltage across primary winding 40. Voltage divider circuit 54 is connected between interconnection 43 and negative D.C. input terminal 22' for developing a signal at terminal 55 which is a scaled value of the voltage level at interconnection 43. Voltage divider 54 includes a series of resistors 66, 70, variable resistor 72 and thermistor 74. Variable resistor 72 can be adjusted as required to trim peak voltage at interconnection 43. Thermistor 74 is a positive temperature controlled device which has a nominal resistance up to a transition temperature, above which its resistance increases very rapidly. Output power of excitation circuit 10 is then reduced by reducing the peak voltage at interconnection 43 as the temperature of the circuit rises above the transistion temperature. Thermistor 74 is selected in a preferred embodiment to have a threshold temperature of 90° C.

Control signal triggering circuit 56 includes a comparator 76 connected to terminal 55 by resistor 78. Comparator 76 generates a turn on signal for propagation to the gate of IGFET 42 when the voltage level on interconnection 43 falls below a minimum value determined by a reference voltage. That peak value, as noted above, can be increased or decreased by adjustment of resistor 72.

Transmission link 60 between comparator 76 and the gate of IGFET 42 includes a series circuit having capacitor 80 and inverting buffers 82 and 84. Inverting buffers 82 and 84 provide a small delay between generation of a control signal and its propagation as a turn on or turn off signal to the gate of IGFET 42. Capacitor 80 couples control signals from comparator 76 to the input of inverting buffer 82. Resistor 85 is connected from between capacitor 80 and inverting buffer 82 to negative D.C. terminal 22' providing a current path from the capacitor to the negative D.C. terminal. Resistor 85 will gradually discharge the high logic level turn on signals at the input of inverting buffer 82, cancelling the turn on signal, and substituting a turn off signal for transmission to the gate of IGFET 42.

Oscillation initiation circuit 62 is adapted to provide a turn on control signal to IGFET 42 where a control signal has not appeared on transmission link 60 in over a given minimum time period or upon start up of excitation circuit 10. Comparator 86 will generate a turn on signal when the voltage potential across capacitor 88, which is connected between the input of comparator 86 and negative D.C. terminal 22', falls below a certain minimum threshold value. Capacitor 88 is charged by periodic transmission of turn on signals from inverter buffer 84 which are coupled to the capacitor by diode 90. Diode 90 is oriented to conduct from the gate of IGFET 42 to capacitor 88 indicating that turn on signals are relatively positive in polarity. A resistor 92 is connected in parallel with capacitor 88 between diode 90 and negative D.C. input terminal 22' for discharging capacitor 88. The resistance value of resistor 92 and the capacitance of capacitor 88 set an RC time constant for determining the time to be required before generation of a turn on signal. Where no turn on signals have appeared over the predetermined minimum time period, capacitor 88 will become sufficiently discharged to cause comparator 86 to generate a turn on signal through diode 94 to the input terminal of inverter buffer 82. Turn on signals from comparator 86 are transmitted to transmission link 60 by a diode 94, oriented to conduct from the output of comparator 86 to the input of inverting buffer 82. Oscillation initiation circuit 62 primarily aids in start up of the excitation circuit and is not necessary in all applications.

The duration of gate control signals generated by control signal triggering circuit 56 is controlled by control signal duration control circuit 58. Control signal duration control circuit 58 includes a bipolar NPN type transistor switch 96 connected at its collector to the input of inverting buffer 82 and at its emitter to negative polarity D.C. input terminal 22'. When transistor 96 is conducting, turn on signals applied to the input of inverting buffer 82 are discharged through both resistor 85 and transistor 96 to negative D.C. input terminal 22'. Transistor 96 is driven into a conductive state by positive polarity base signals supported by capacitors 104 and 106. Capacitors 104 and 106 are charged through Zener Diodes 98 and 100. Zener diodes 98 and 100 are connected, respectively, to terminal 55 and to secondary winding 46 in transformer 36. A diode 101 is connected in series with Zener 100 and secondary winding 46 to prevent forward conduction through Zener 100. Zeners 98 and 100 each have their breakdown conductive directions oriented to conduct from terminal 55 and secondary winding 46, respectively, to resistor 102. The voltage level on terminal 55 is a proportional value of the voltage level on interconnection 43, i.e. the voltage level on the drain of IGFET 42. Accordingly, a threshold voltage level exists on interconnection 43. The degree to which the voltage exceeds the threshold voltage determines the extent to which capacitors 104 and 106 are charged and the consequential shortening of the period during which IGFET 42 operates. The threshold voltage level is subject to change depending upon the temperature at which the circuit is operated due to changes in the voltage scaling at terminal 55 as previously described.

Zener 100 operates in breakdown when voltages across secondary winding 46, when used, rise above a threshold value. Winding 46 is used to control open circuit output voltage on terminals 14. Because primary winding 40 and secondary winding 44 are loosely coupled, open circuit output voltage is not easily predictable. Loose flux coupling characteristic of high leakage reactance transformers, along with capacitive loading, can result in resonance effects which change open circuit output voltage.

The amount of power transferred through transformer 36 is a function of primary current through winding 40 and peak voltage levels at interconnection 43. Maximum primary current, and maximum voltage levels occurring on interconnection 43, are functions of how long IGFET 42 is on with each turn on pulse. Excess peak primary current in primary winding 40 is also reflected, under open circuit operation, in higher peak voltages across secondary winding 46 resulting in reverse breakdown current transmission by Zener 100, and consequential charging of capacitors 104 and 106. Maintaining a constant peak voltage at interconnection 43 provides the proper output currents for lamp 15 loads from zero to the maximum rated load of the excitation circuit, or limits maximum open circuit output voltage on terminals 14.

Figure 2A:
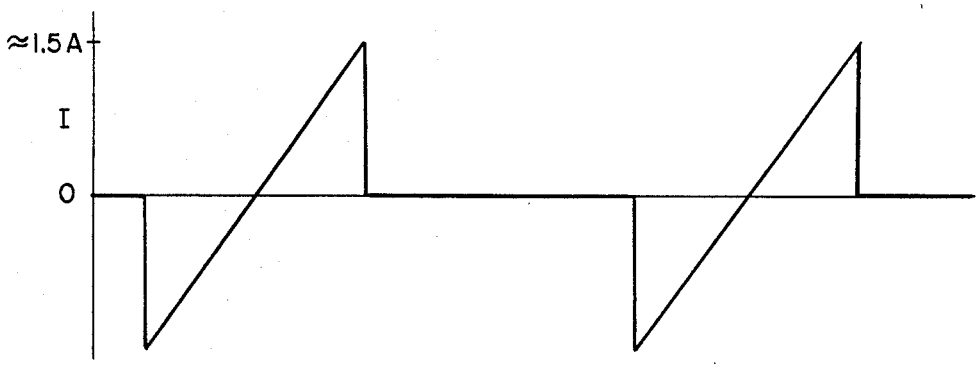
FIGS. 2A–C are a set of waveforms illustrating operation of the circuit.
Figure 2B:
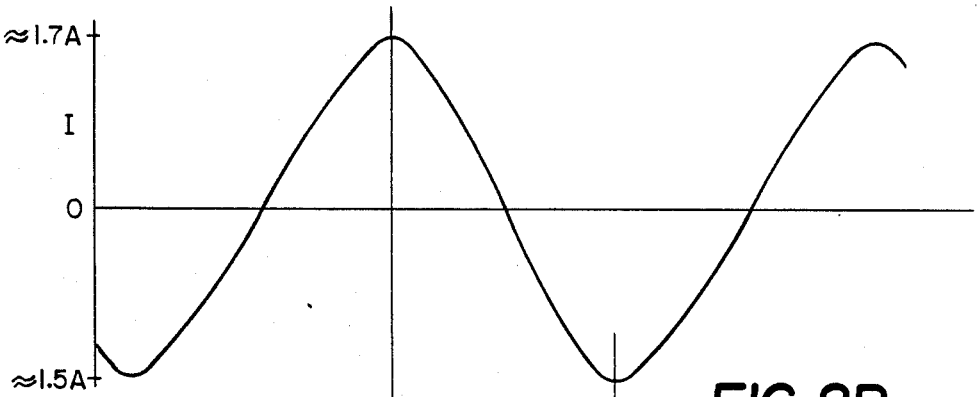
Figure 2C:
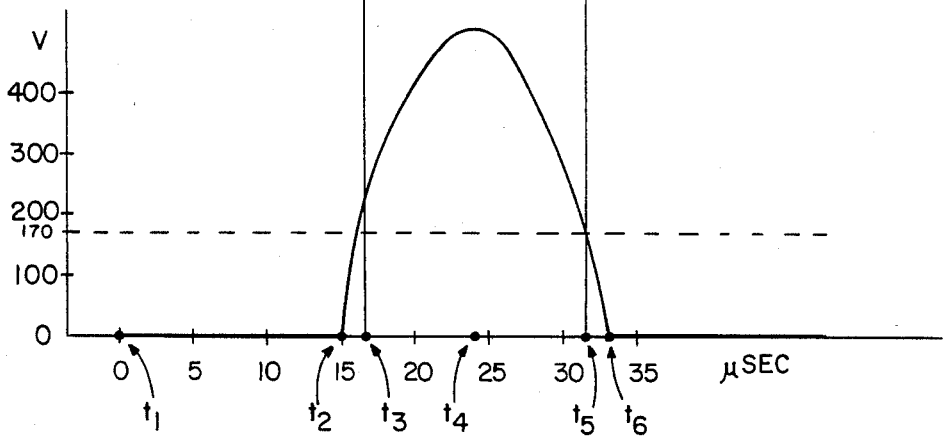

Understanding of the operation of excitation circuit 10 may be aided by reference to FIG. 1 and the waveforms of in FIGS. 2A–C which illustrate short circuit operation. FIG. 2A illustrates drain current through IGFET 42, FIG. 2B illustrates primary current through primary winding 40 and FIG. 2C illustrates voltage level at interconnection 43 and the steady state D.C. voltage level at D.C. input terminal 22, both relative to negative D.C. input terminal 22'. The waveform illustratons are interrelated by reference to a common time scale in microseconds.

Control of the power transferred or the open circuit output voltage of excitation circuit 10 is a matter of control of the primary current through primary winding 40. Control of the primary current is ultimately a matter of the control of voltages applied across primary winding 40. 155 to 170 volt D.C. power is provided on D.C. input terminals 22 and 22'. At time T1, the voltage level at interconnection 43 goes slightly negative and diode 50 begins to conduct. Thus current is no longer drawn from capacitor 48. IGFET 42 can turn on at any time after T1, but preceding the primary current going positive. A 170 volt differential, i.e. the differential between D.C. input terminals 22 and 22', is applied across primary winding 40 when IGFET 42 begins conducting. Drain current initially flows from source to drain through IGFET 42 to support the primary current, which at time T1 is assumed to have an initial value of −1.4 amperes, that is, 1.4 amperes flowing from interconnection 43 to positive D.C. input terminal 22, but increases thereafter to a forward current of almost 1.7 amperes at T2.

Because the voltage differential across primary winding 40 is 170 volts, opposing the direction of primary current flow, primary current begins reversing at the moment IGFET 42 begins conducting and climbs linearly, going positive at about 7 microseconds after T1 and reaching a maximum value of about +1.7 amperes at T3 or 16 microseconds after T1. IGFET 42 drain current tracks forward primary current until T2 (15 microseconds). At T2, IGFET 42 ceases conducting and the voltage level at interconnection 43 begins to rise rapidly, forward primary current now being directed to charging capacitor 48. The polarity across primary winding 40 reverses at T3 and the voltage level at interconnector 43 rises rapidly to a peak value of approximately 500 volts (330 volts across the primary winding) at T4.

IGFET 42 is turned off in response to any one of a number of conditions. If the peak voltage is less than the desired maximum due to low line to line voltage across A.C. input terminals 12, the RC time constant of capacitor 80 and resistor 85, i.e. the rate at which resistor 85 discharges a control signal, determines the time duration for which IGFET 42 will conduct. Where A.C. line voltage exceeds about 100 volts, control signal duration control circuit 58 operates to shorten the period of time during which IGFET 42 conducts, thus limiting the absolute maximum forward primary current in primary winding 40 and, consequentially, limiting the peak voltage appearing at interconnection 43. Under such operating conditions, the extent to which capacitor 48 charges is also limited.

A condition under which the on time duration is reduced is when voltage excursions across secondary winding 46 are such that Zener 100 is driven into breakdown, resulting in charging of capacitors 104 and 106. Large voltage excursions across secondary winding 46 indicate excessive output voltage excursions.

The capacitance value of capacitor 48 and the inductance of primary winding 40 are selected to provide a parallel pseudo-resonant circuit with a resonant frequency of about 25 KHz, or about the frequency of turn on pulses during operation at optimal A.C. line voltage. Of course, the resonant frequency can be varied from 25 KHz, without changing the basic operation of the circuit, where the circuit is intended for use at different frequencies. The circuit is called pseudo-resonant because its operating frequency is fundamentally determined by the switching frequency of IGFET 42. The pseudo-resonant circuit provided by winding 40 and capacitor 48 contributes to overall excitation circuit 10's efficiency, greater reliability and reduced electromagnetic interference.

As described above, the polarity reversal of voltages applied across primary winding 40 results in the primary current peaking at T3. Thereafter primary current starts to fall until reversing at T4, at which point capacitor 48 is charged to its maximum extent for the cycle. Peak voltage at interconnection 43 and across the primary winding occurs at T4. The voltage level at interconnection 43 thereafter begins to fall. As indicated above, depending upon the level of the peak voltage, Zener diode 98 will have operated to charge capacitors 104 and 106 effecting the duration of the next occurring conductive period of IGFET 42.

At T5, the voltage level at interconnection 43 has fallen to a level resulting in no net potential across winding 40, also the point in time of peak reverse primary current. At some point between T5 and T6, a turn on control signal is generated as a result of the voltage level at interconnection 43 falling below a threshold. At T6, the voltage level at interconnection 43 is clamped just below the level of negative D.C. terminal 22' because of the inherent Zener diode 50 in IGFET 42. If capacitor 48 is not fully discharged at T6, i.e. the voltage level at interconnection 43 is above negative terminal 22', the remaining energy in capacitor 48 is dissipated in IGFET 42 in the IGFET.

The operation of excitation circuit 10 continues in cyclic fashion thereafter, generating high voltage, high frequency A.C. on output terminals 14.

A neon lamp power source is provided employing a MOSFET switching element with optimally controlled peak voltage levels. Plural levels of overvoltage protection are provided giving average longer life for the excitation circuit and a lamp powered thereby.

Although the present invention has been described with reference to preferred embodiments, workers skilled in the art will recognize that changes may be made in form and detail without departing from the spirit and scope of the invention.

What is claimed is:

1. An excitation circuit for a gas discharge lamp, the circuit comprising:

A.C. input terminals for connection to a source of power;

A.C. output terminals for connection to the gas discharge lamp;

a rectifying circuit for opposite polarity output terminals connected across the A.C. input terminals;

a transformer with a primary-winding and a secondary winding;

the secondary winding being connected across the A.C. output terminals;

an inverter circuit connected with the primary winding across the output terminals of the rectifier for controlling current in the primary winding, the inverter circuit including, an electrical interconnection node between the inverter circuit and the primary winding of the transformer, switch means, connected to the interconnection node and forming a series circuit with the primary winding across the opposite polarity output terminals and having a control input, for establishing a current in the primary winding of the transformer, and a capacitor connected at one terminal to the electrical interconnection node to be charged by current through the primary winding during periods when the switch means is nonconducting; and an inverter control circuit connected to the interconnection node responsive to voltage levels occurring thereon to provide a control signal to the switch means of the inverter circuit, the inverter control circuit including, a trigger circuit generating a turn on signal in response to the voltage level at the interconnection node, a control signal duration limiting means responsive to excursions in the voltage level at the interconnection node for limiting the duration of the turn on signal, and a transmission link for transmitting control signals including the duration limited turn on signal to the control input of the switch means.

2. The excitation circuit of claim 1 wherein the inductance of the primary winding and the capacitance of the capacitor are selected to have a resonant frequency substantially equal to the operating frequency of the switch means.

3. The excitation circuit of claim 2 wherein the switch means is an IGFET connected at its drain to the interconnection node.

4. The excitation circuit of claim 1 wherein the inverter control circuit further includes:

an initiation circuit connected to the transmission link for generating a turn on signal in the absence of occurrence of a turn on signal for a period of time exceeding a predetermined minimum.

5. The excitation circuit of claim 1 wherein the inverter control circuit comprises a voltage dividing circuit connected between the interconnection node and a voltage reference developing a signal proportional to the voltage level on the interconnection node for transmission to the triggering circuit and to the control signal duration limiting circuit.

6. The excitation circuit of claim 5 wherein the voltage dividing circuit further comprises a thermistor responsive to temperature excursions of the excitation circuit exceeding a threshold value for changing interconnection node voltage levels and excursions at which turn on signals are generated and their duration.

7. The excitation circuit of claim 1 wherein the transformer further comprises a second secondary winding for generating a voltage signal indicating the output voltage level.

8. The excitation circuit of claim 7 wherein the control signal duration limiting means is further responsive to the voltage signal indicating the output voltage level for limiting the duration of the turn on signals.

9. An excitation circuit comprising:

D.C. input terminals;

a transformer with a primary winding and a secondary-winding;

A.C. output terminals at opposite ends of the secondary winding;

an inverter circuit connected in series with the primary winding across the D.C. input terminals; and an inverter control circuit connected to an interconnection between the primary winding and the inverter circuit and responsive to the voltage level appearing thereon for transmitting control signals to the inverter circuit for controlling the current through the primary winding, the inverter control circuit including, a trigger circuit responsive to the voltage level on the interconnection for generating inverter turn on signals;

a turn on signal duration limiting circuit responsive to maximum excursions of the voltage level at the interconnection for reducing the duration of the turn on signals; and a transmission link for transmitting the duration limited turn on signals to the inverter circuit.

10. The excitation circuit of claim 9 wherein the inverter circuit further includes:

switch means with a control input connected in series with the primary winding between the D.C. input terminals for establishing current flow in the primary winding; and a capacitor connected between the interconnection and a voltage reference.

11. The excitation circuit of claim 9 wherein the inverter control circuit includes an initiation circuit connected to the transmission link for generating a turn on signal absent occurrence of a turn on signal on the transmission link for a period of time exceeding a predetermined minimum.

12. The excitation circuit of claim 9 wherein the inverter control circuit further includes a voltage dividing circuit connected between the interconnection and a voltage reference for developing a signal proportional to the voltage level on the interconnection for transmission to the triggering circuit and to the turn on signal duration limiting circuit.

13. The excitation circuit of claim 12 wherein the voltage dividing circuit further includes a thermistor responsive to temperature excursions of the excitation circuit beyond predetermined threshold values for changing interconnection voltage levels at which turn on signals are generated.

14. The excitation circuit of claim 9 wherein the transformer further comprises a second secondary winding for generating a signal indicating the A.C. output terminal voltage.

15. The excitation circuit of claim 14 wherein the turn on signal duration limiting circuit is further responsive to the signal indicating the A.C. output terminal voltage difference for limiting the duration of the turn on signals.

16. An inverter circuit comprising:

D.C. input terminals;

A.C. output terminals;

a transformer having a primary winding with first and second terminals and having a secondary winding with first and second terminals;

the primary winding first terminal being connected to a first polarity D.C. input terminal and the A.C. output terminals being connected across the secondary winding first and second terminals;

switch means connected between the primary winding second terminal and a second polarity D.C. input terminal for establishing current flow in the primary winding;

capacitor means connected between the primary winding second terminal and a voltage reference level for charging through the primary winding when the switch means is nonconducting; and switch means control means connected to and responsive to the voltage level across the capacitor means for controlling the nonconducting and conducting periods of the switch means, the switch means control means including, a voltage dividing circuit connected between the interconnection and a D.C. input terminal for developing a scaled triggering signal, a trigger circuit responsive to the scaled triggering signal for generating turn on signals, turn on signal duration limiting means responsive to the voltage level of the scaled triggering signal for limiting the duration of the control signals, and a transmission link for transmitting duration limited turn on signals to the control input of the switch means.

17. The excitation circuit of claim 16 wherein the switch means control means further includes an initiation circuit connected to the transmission link for generating a turn on signal whenever a period of time exceeding a predetermined minimum has expired without occurrence of a turn on signal on the transmission link.

18. An excitation circuit comprising:

a rectifier for connection to a source of A.C., the rectifier having opposite polarity D.C. output terminals;

a transformer with a primary winding and a secondary winding;

an inverter circuit connected to the primary winding, the inverter circuit having, a solid state switch with a control input connected in series with the primary winding across the D.C. output terminals and a capacitor connected between an interconnection between the solid state switch and the primary winding between the interconnection and a D.C. output terminal; and an inverter control circuit connected to the interconnection, the inverter control circuit including:

a voltage dividing circuit connected between the interconnection and a D.C. output terminal for developing a scaled triggering signal, a trigger circuit responsive to the scaled triggering signal for generating control signals including turn on and turn off signals, a control signal duration control circuit responsive to the voltage level of the scaled triggering signal for controlling the relative duration of the control signals, a transmission link for transmitting the control signals to the control input of the switch means, and an initiation circuit connected to the transmission link for generating a turn on signal for transmission on the link in the absence of a turn on signal on the transmission link for a period of time exceeding a predetermined minimum.

19. The excitation circuit of claim 18 wherein the inverter circuit further includes a MOSFET connected at its drain to the interconnection.

* * * * *

UNITED STATES PATENT AND TRADEMARK OFFICE

CERTIFICATE OF CORRECTION

PATENT NO. : 4,933,612

DATED : June 12, 1990

INVENTOR(S) : Wayne A. Bonin

It is certified that error appears in the above-identified patent and that said Letters Patent is hereby corrected as shown below:

ON THE TITLE PAGE:

In the Reference Cited Section, insert the following:

OTHER PUBLICATIONS

Modern Electronic Circuits Reference Manual by John Markus, Copyright 1980, McGraw-hill, New York, New York, page 84.

Application Note AN-969 of International Rectifier, "Economic, High Performance, High Efficiency Electronic Ignition with Avalanche-Rated HEXFETs.

Col. 8, line 38, after "control circuit", insert --further--

Signed and Sealed this

Sixteenth Day of July, 1991

*Attest:*

*Attesting Officer*

HARRY F. MANBECK, JR.

*Commissioner of Patents and Trademarks*